US009661963B2

(12) United States Patent
Desai

(10) Patent No.: US 9,661,963 B2
(45) Date of Patent: May 30, 2017

(54) KIT FOR CONFIGURING TOILET FOR DISABLED PERSONS

(71) Applicant: Kishor C. Desai, Winter Park, FL (US)

(72) Inventor: Kishor C. Desai, Winter Park, FL (US)

( * ) Notice: Subject to any disclaimer, the term of this patent is extended or adjusted under 35 U.S.C. 154(b) by 122 days.

(21) Appl. No.: 14/798,378

(22) Filed: Jul. 13, 2015

(65) Prior Publication Data

US 2017/0014008 A1 Jan. 19, 2017

(51) Int. Cl.

| | |
|---|---|
| ***A47K 13/00*** | (2006.01) |
| ***A47K 13/26*** | (2006.01) |
| ***A47K 13/02*** | (2006.01) |
| ***A47K 17/02*** | (2006.01) |

(52) U.S. Cl.
CPC ..... *A47K 13/26* (2013.01); *A47K 13/005* (2013.01); *A47K 13/02* (2013.01); *A47K 17/02* (2013.01); *A47K 17/022* (2013.01)

(58) Field of Classification Search
CPC ..... A47K 13/26; A47K 17/022; E03D 9/05
USPC ..... 4/234
See application file for complete search history.

(56) References Cited

U.S. PATENT DOCUMENTS

| | | | | |
|---|---|---|---|---|
| 2,980,922 | A | 4/1961 | Taylor | |
| D212,327 | S * | 10/1968 | Brewer | D23/311 |
| 4,213,211 | A | 7/1980 | Bemis et al. | |
| 5,448,781 | A | 9/1995 | Miller | |
| 5,920,917 | A | 7/1999 | Landsberger | |
| 6,516,475 | B1 * | 2/2003 | Anderson | E03D 11/02 4/420.4 |
| 7,073,210 | B2 | 7/2006 | Jiang | |
| 7,194,772 | B2 * | 3/2007 | Rie | E03D 11/02 4/254 |
| D685,067 | S * | 6/2013 | Du | D23/301 |
| D706,402 | S | 6/2014 | Yeung | |
| 8,763,169 | B2 | 7/2014 | Daniels et al. | |
| 2012/0060272 | A1 | 3/2012 | Tordella | |
| 2013/0276221 | A1 | 10/2013 | Desai | |

FOREIGN PATENT DOCUMENTS

| | | |
|---|---|---|
| EP | 1 704 806 A2 | 9/2006 |
| FR | 2 643 249 | 8/1990 |

* cited by examiner

*Primary Examiner* — Huyen Le
(74) *Attorney, Agent, or Firm* — Richard C. Litman

(57) ABSTRACT

The kit for configuring a toilet for disabled persons includes a toilet seat having a front portion having a first width and a back portion having a second width, the first width being greater than the second width, a top surface, and a bottom surface having a downward sloping wall configured for mating onto a toilet bowl of a toilet, and a mounting plate attached to the back portion of the toilet seat, the mounting plate having at least one opening configured for receiving a fastener for attaching the toilet seat onto the toilet. The top surface of the toilet seat can include a channel configured for receiving a conventional toilet seat. The kit can also include a support member, such as a floor-mounted handle bar or at least one wall-mounted handle bar, and a lid.

12 Claims, 10 Drawing Sheets

KIT FOR CONFIGURING TOILET FOR DISABLED PERSONS

BACKGROUND OF THE INVENTION

1. Field of the Invention

The present invention relates to toilet seats, and particularly to a kit for converting a toilet for disabled persons.

2. Description of the Related Art

In comparison to circular toilet seats, conventional oblong toilets are typically arranged with the broader part of the seat (i.e., the part of the toilet seat on which the user sits/places their buttocks) is positioned at the rear, meaning nearest to the cistern/flushing tank, and the seat narrows towards the front. This is typically the case for all toilets, regardless of whether they are close-coupled or not, or whether they are designed for able-bodied people or handicapped/disabled persons. Despite the hardships, people suffering from physical and/or mental disabilities, such as Muscular Dystrophy, Alzheimer's, spinal cord injuries or amputees, have to use conventional toilets having conventional toilet seats, since there are no other options available to them.

For example, it is often difficult for a person confined to a wheelchair to use a conventional toilet seat since he/she cannot make the transfer directly onto the conventional toilet seat. He/she must first turn the wheelchair 180°, move the wheelchair in reverse to be next to the toilet seat, and then maneuver onto the toilet seat. Moreover, this process is also difficult and cumbersome for caregivers, since the caregiver must first lift the person off of the wheelchair, carry him/her to the toilet, turn him/her around 180°, and then put him/her on the toilet seat.

Thus, a kit for configuring a toilet for disabled persons solving the aforementioned problems is desired.

SUMMARY OF THE INVENTION

A first embodiment of a kit for configuring a toilet for disabled persons includes a disabled person's toilet seat having a front portion having a first width and a back portion having a second width, the first width being greater than the second width, the seat defining a top surface and a bottom surface having a downward sloping wall configured for mating onto a toilet bowl of a conventional toilet, and a first attachment coupled to the back portion of the toilet seat, the first attachment having at least one opening configured for receiving a fastener configured for anchoring the toilet seat onto the conventional toilet. The first embodiment of the kit can also include a support member, such as a floor-mounted handle bar or at least one wall-mounted handle bar.

A second embodiment of a kit for configuring a toilet for disabled persons includes a disabled person's toilet seat having a front portion having a first width and a back portion having a second width, the first width being greater than the second width, the seat defining a top surface having a channel configured for receiving a conventional toilet seat and a bottom surface having a downward sloping wall configured for mating onto a toilet bowl of a toilet, and a first attachment coupled to the back portion of the toilet seat, the first attachment having at least one opening configured for receiving a fastener configured for anchoring the toilet seat onto the toilet. The second embodiment of the kit can also include the support member, such as the floor-mounted handle bar and at least one wall-mounted handle bar, and a lid.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 4:
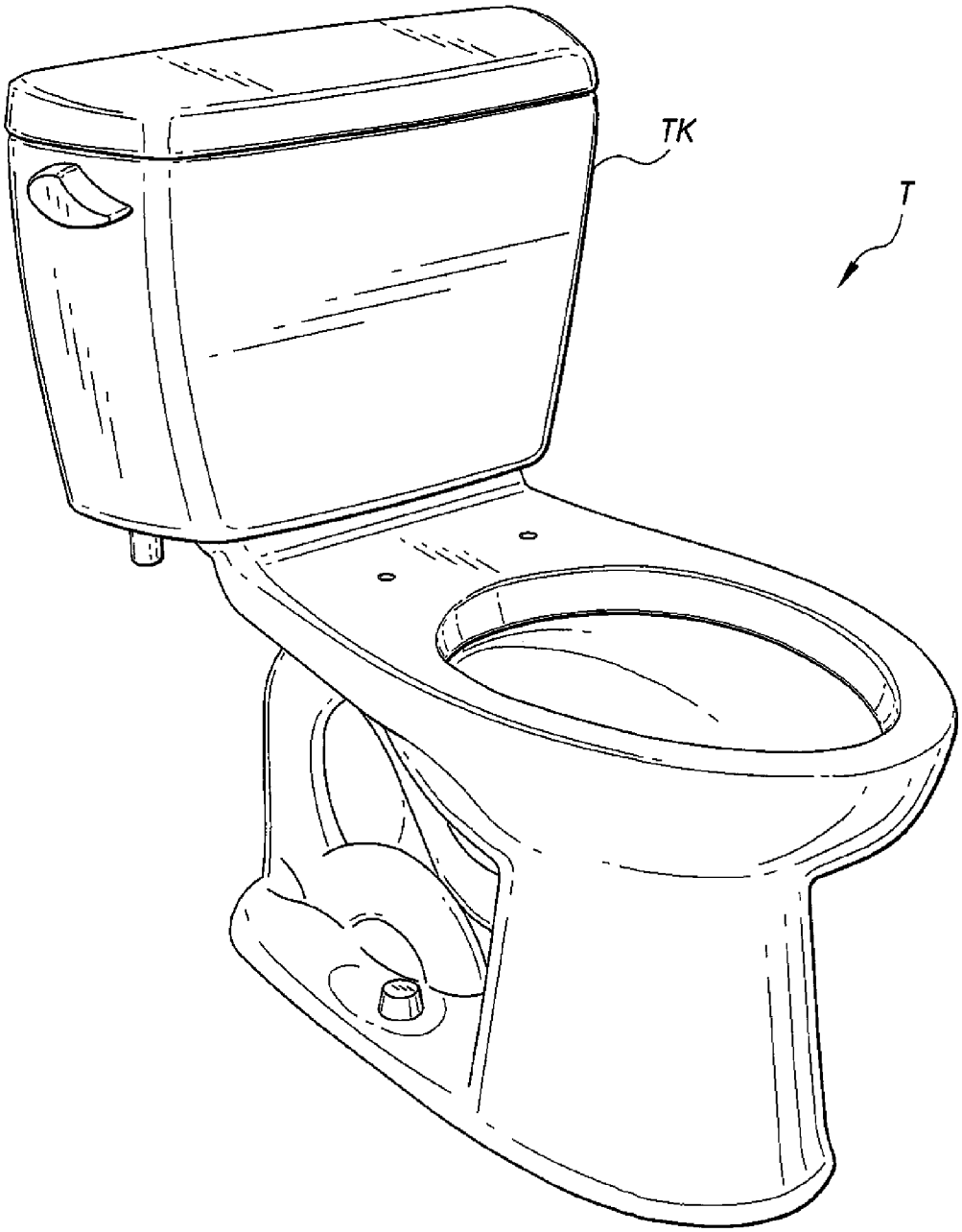
PRIOR ART Fig. 4
FIG. 4 is a perspective view of a toilet according to the prior art.

Referring to FIGS. 1A-2C, a first embodiment of a kit 100 for configuring a toilet T for use by disabled persons is generally illustrated. The conventional toilet T can be any type of conventional toilet already known in the art, such as a circular toilet or an oblong toilet, as illustrated in FIG. 4.

Figure 1A:
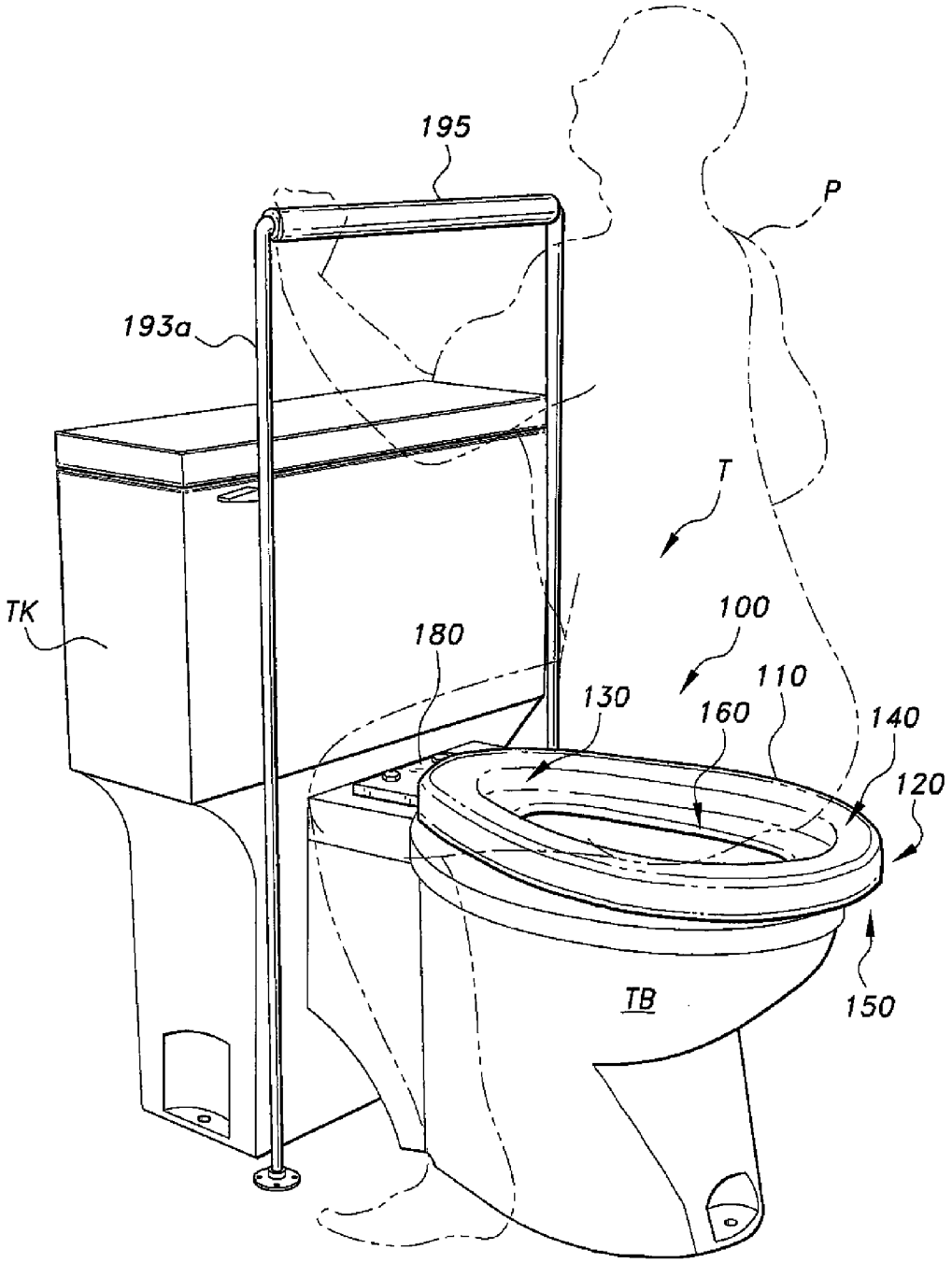
FIG. 1A is an environmental perspective view of a first embodiment of a kit for configuring a toilet for disabled persons according to the present invention, the kit having a toilet seat and a floor-mounted handle bar.
Figure 1B:
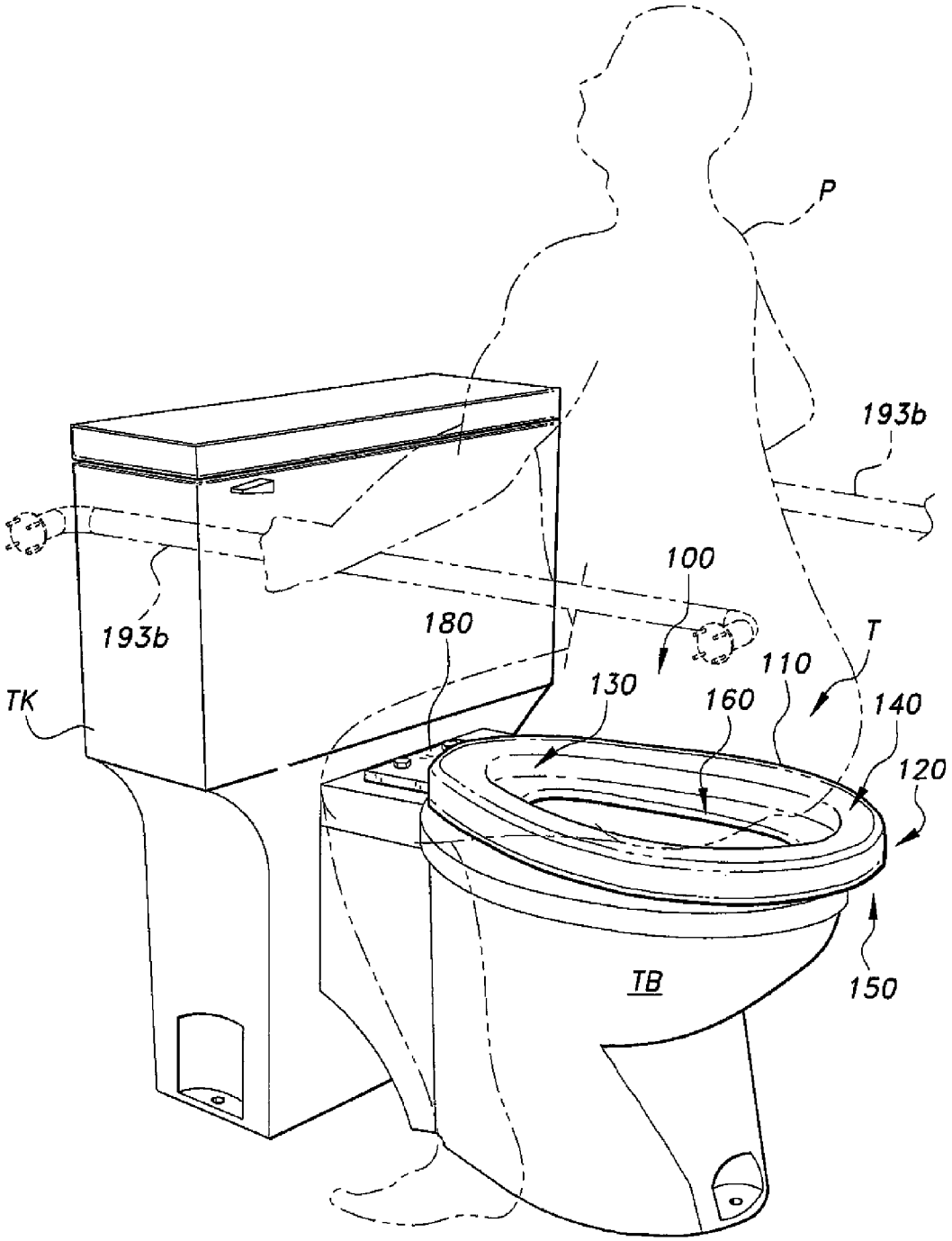
FIG. 1B is an environmental perspective view of a first embodiment of a kit for configuring a toilet for disabled persons according to the present invention, the kit having a toilet seat and a wall-mounted handle bar.

The kit 100 includes a disabled person's toilet seat 110 having a front portion 120 having a first width W1 and a back portion 130 having a second width W2, the first width W1 being greater than the second width W2. The seat 110 defines a top surface 140 and a bottom surface 150 having a downward sloping wall 160 configured for mating onto a toilet bowl TB of the conventional toilet T. The toilet seat 110 is turned 180° from the normal position of a conventional toilet seat when it is fastened to the toilet T so that the disabled person P using the conventional toilet T faces the tank TK, as illustrated in FIG. 1A. This can allow the disabled person P, such as a person confined to a wheelchair, to use the conventional toilet T without having to maneuver 180° to sit down. For example, instead of having to maneuver 180°, the disabled person P can slide forward directly from the wheelchair onto the toilet seat 110. Once the disabled person P is done using the toilet T, he/she can slide backwards onto the wheelchair.

The kit 100 can also include a first attachment 180 coupled to the back portion 130 of the toilet seat 110. The first attachment 180 can include at least one opening 200

(preferably two openings) configured for receiving a fastener 210 for anchoring the toilet seat 110 to the toilet T, and a support member, such as a floor-mounted handle bar 193*a* or at least one wall-mounted handle bar 193*b* for assisting the disabled person P in getting onto and off of the toilet seat 110.

The toilet seat 110 can be made from any suitable type of material, such as plastic for thermoset seats, thermoplastic seats, or resin toilet seats, or wood, such as MDF/compressed wood or natural/solid wood, and can have any suitable size to fit any type of toilet T already known in the art. The toilet seat 110 can have any suitable length L needed to cover the toilet bowl TB of the conventional toilet T. Further, the toilet seat 110 can include a raised toilet seat (i.e., it may be vertically thick) to make it easier for a disabled person to get on and off the toilet seat 110. It is to be noted that the top surface 140 of the toilet seat 110 can include padding, which can be formed from any suitable type of bacterial- and/or microbial-resistant material, in order to provide a cushion between the person's P buttocks and the top surface 140 of the toilet seat 110 to increase his/her comfort.

Figure 2A:
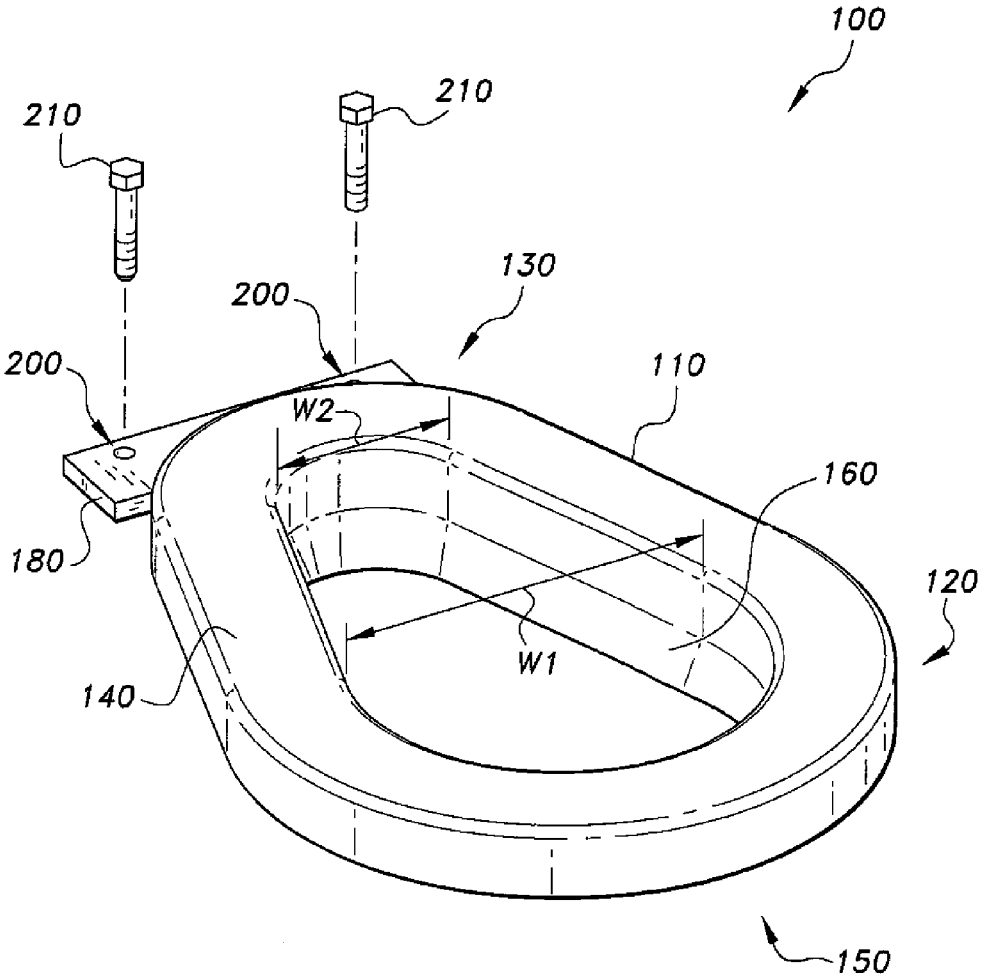
FIG. 2A is a perspective view of the toilet seat component in a first embodiment of a kit for configuring a toilet for disabled persons according to the present invention.
Figure 2B:
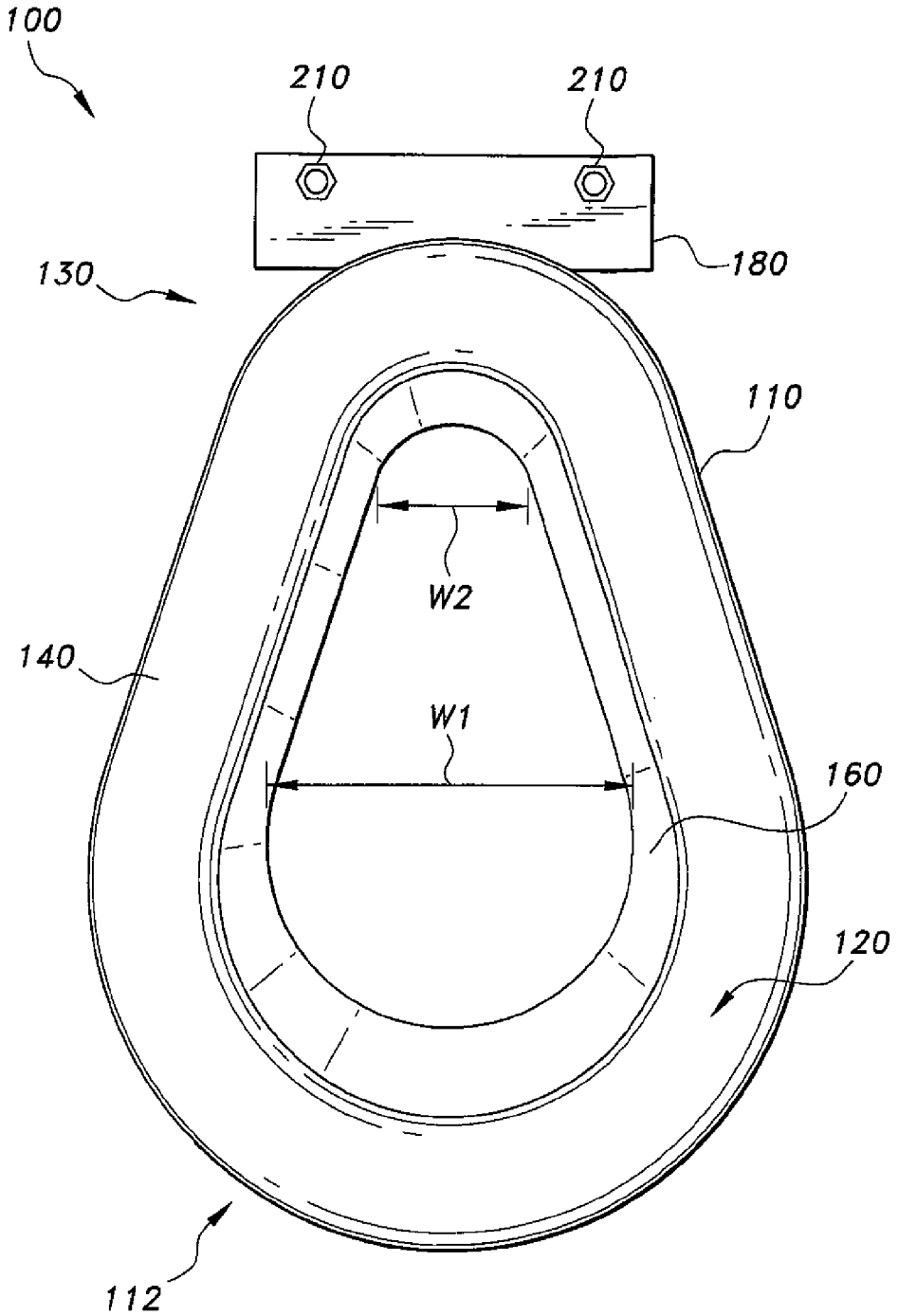
FIG. 2B is a top view of the toilet seat of FIG. 2A.
Figure 2C:
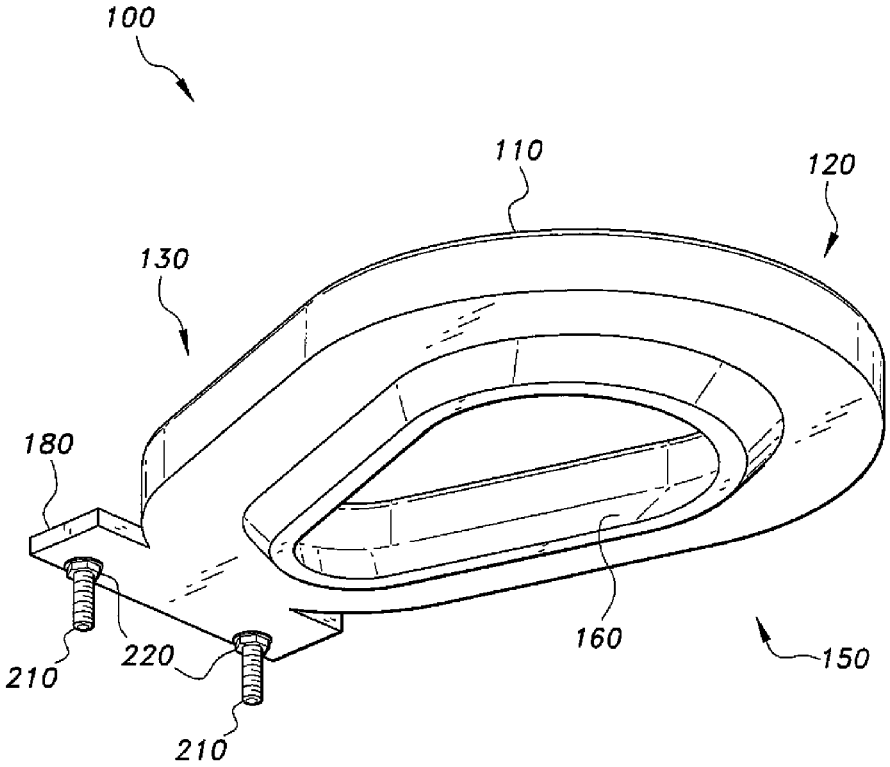
FIG. 2C is a bottom perspective view of the toilet seat of FIG. 2A.

The downward sloping wall 160 of the bottom surface 150 of the toilet seat 110, as illustrated in FIG. 2C, can have any suitable downward slope so that the bottom surface 150 of the toilet seat 110 can mate with the toilet bowl TB of the toilet T. Further, the downward sloping wall 160 can have any suitable length, such as between 2 and 3 inches, to prevent any substances from escaping from between the toilet seat 110 and the toilet bowl TB onto the floor. Further, it is to be noted that the front portion 120 of the toilet seat 110 can overhang the front of the toilet bowl TB, as illustrated in FIG. 1, to provide more support for the disabled person P using the toilet seat 110.

The at least one fastener 210 can be any type of suitable fastener, such as a bolt, and can be made from any type of material, such as plastic or metal, suitable to fasten the back portion 130 of the toilet seat 110 to the conventional toilet T. A nut 220 is used to secure the at least one fastener 210 the toilet T.

The support member can include any type of suitable support member, such as the floor-mounted handle bar 193*a* (FIG. 1A) or the at least one wall-mounted handle bar 193*b* (preferably two wall-mounted handle bars) (FIG. 1B), examples of which are disclosed in Patent Application 2013/0276221 A1, which is hereby incorporated by reference. Further, the support member 193*a*, 193*b* can be secured to the floor or the wall, respectively, by any suitable means, as disclosed in the '221 application.

The support member 193*a*, 193*b* can be formed from any type of material, such as metal, suitable to provide support for the person using the toilet T, such as to aid the person in getting onto and off of the toilet seat 110. The support member 193*a*, 193*b* can also include a gripping member 195 to prevent the disabled person's P hand(s) from slipping off of the support member 13*a*, 193*b* while getting onto or getting off of the toilet seat 110. The gripping member 195 can be made from any suitable material, such as a medical grade material that is preferably formed from a bacteria- and microbial-resistant substance to reduce the possibility of contact with infectious or contagious disease carriers to not only prevent people's hands from slipping off of the support member 193*a*, 193*b*, but also to prevent infection.

Referring to FIGS. 3A through 5B, a second embodiment of a kit 300 having a toilet seat 310 used to convert a conventional toilet T (FIG. 4) to one that can be used by disabled persons P is generally illustrated. The kit 300 is substantially similar to the kit 100 described above. The difference between the kit 100 described above and the kit 300 is that the kit 300 includes a toilet seat 310 having a top surface 340 including a channel 345 configured for receiving a conventional toilet seat 320 to allow non-handicapped persons to also use the conventional toilet T. The kit 300 may include the conventional toilet seat 320. Similar to the toilet seat 110, the toilet seat 310 also includes a bottom portion 350 having a downward sloping wall 360, similar to the downward sloping wall 160 described above, that can extend into the toilet bowl TB of the conventional toilet T. The conventional toilet seat 320 may be smaller than the toilet seat 310 to fit into the channel 345 of the top surface 340 of the toilet seat 310, as illustrated in FIGS. 3A, 3B, and 5A, 5B.

Figure 5A:
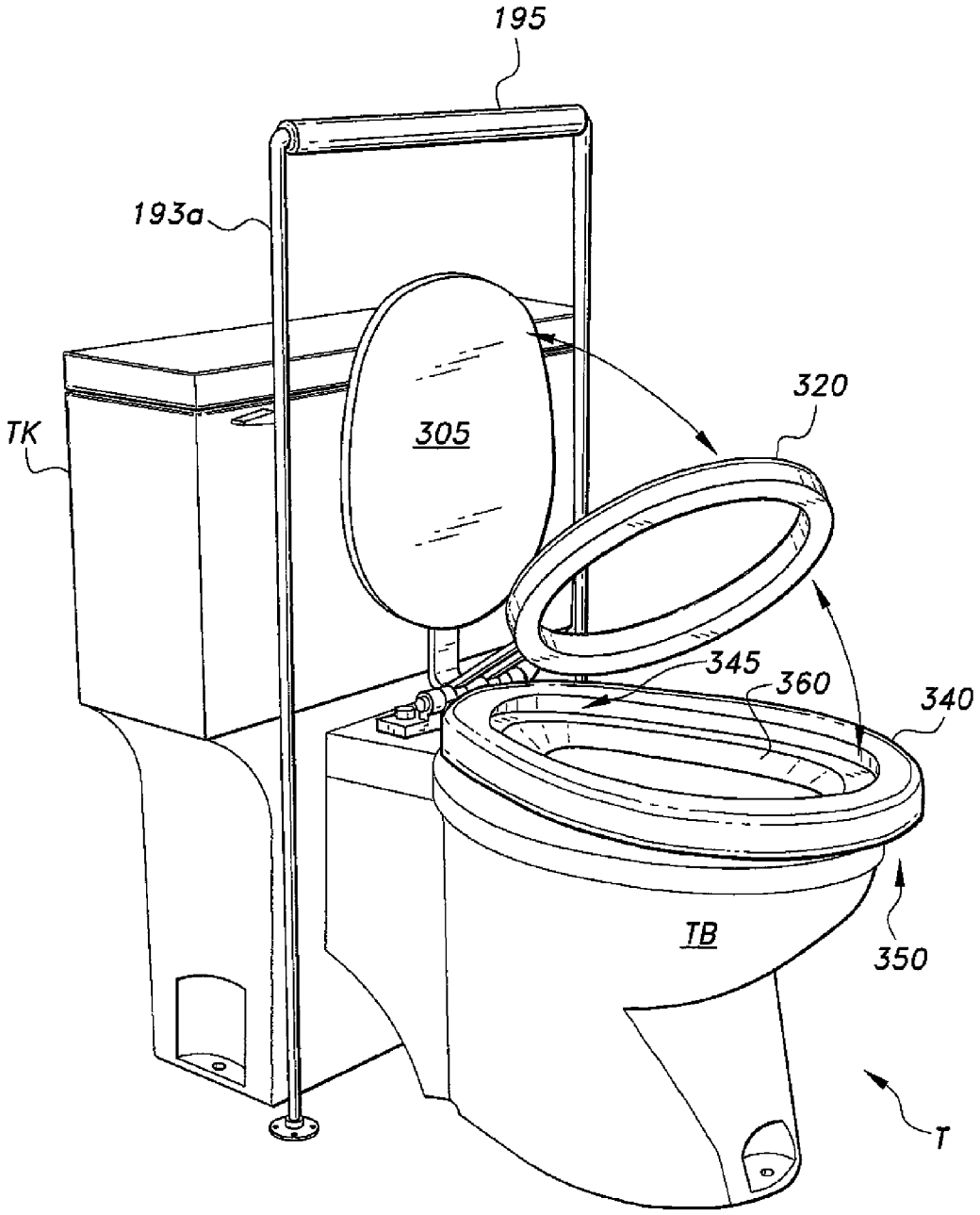
FIG. 5A is an environmental perspective view a second embodiment of a kit for configuring a toilet for disabled persons according to the present invention, having a floor-mounted handle bar.
Figure 5B:
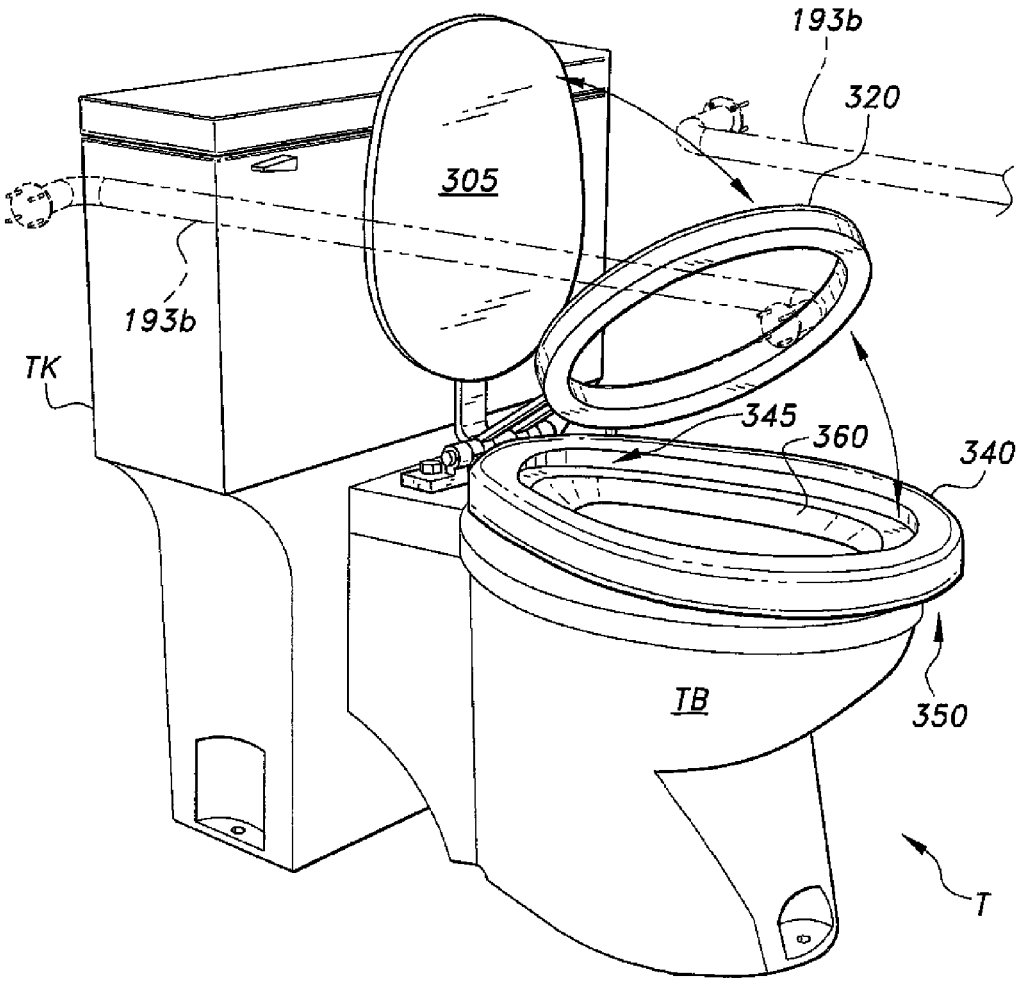
FIG. 5B is an environmental perspective view a second embodiment of a kit for configuring a toilet for disabled persons according to the present invention, having a wall-mounted handle bar.

The kit 300 can also include a lid 305 made from any type of suitable material, such as plastic or wood, that can be used to close the conventional toilet T and prevent any objects from entering the conventional toilet T when the conventional toilet T is not being used, and may include the support member 193*a*, 193*b*, as illustrated in FIGS. 5A and 5B, respectively, that can include the gripping member 195.

Figure 3A:
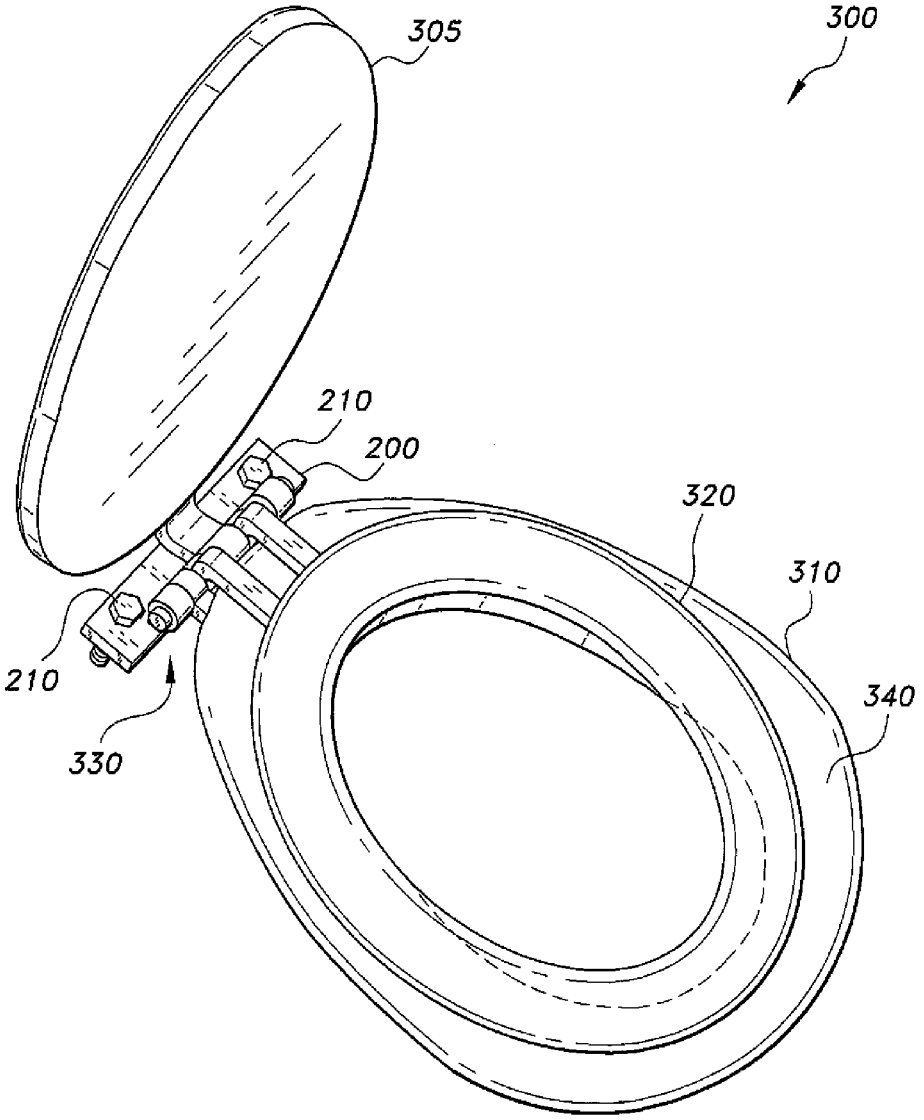
FIG. 3A is a top view of a toilet seat component of a second embodiment of a kit for configuring a toilet for disabled persons according to the present invention.
Figure 3B:
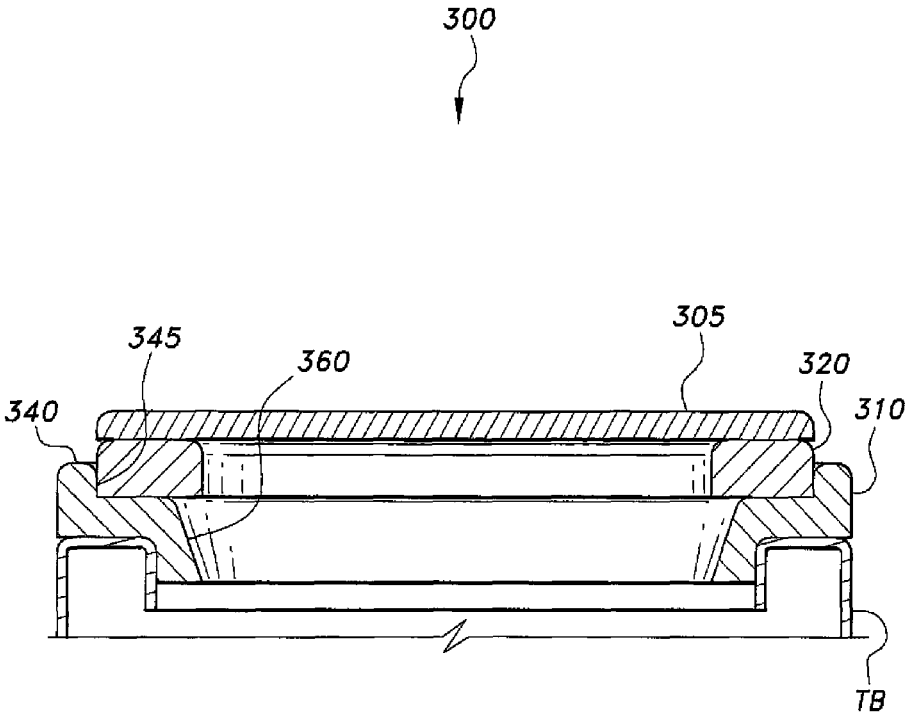
FIG. 3B is an environmental side view in section of the toilet seat of FIG. 3A.

By way of operation, the lid 305 can be positioned on top of the conventional toilet seat 320, which can, in turn, be positioned on top of the toilet seat 310, as illustrated in FIG. 3B, such that the conventional toilet seat 320 is between the lid 305 and the toilet seat 310. It is to be noted that the toilet seat 310 is positioned beneath the conventional toilet 320, as illustrated in FIGS. 5A and 5B, so that the downward sloping wall 360 of the bottom surface 350 of the toilet seat 310 can extend into the toilet bowl TB of the conventional toilet T. Further, the lid 305, the conventional toilet seat 320, and the toilet seat 310 can connected to each other by any suitable means, such as by hinges 330, wherein the lid 305 and the conventional toilet seat 320 can be moved, such as in an upward or in a downward direction, as illustrated by the double ended arrows in FIGS. 5A and 5B, so that the disabled person P can lift the lid 305 and the conventional toilet seat 320 and use the conventional toilet T, and a non-handicapped person can lower the conventional toilet seat 320 into the channel 340 of the disabled top surface 340 of the toilet seat 310 to use the conventional toilet T.

It is to be understood that the present invention is not limited to the embodiments described above, but encompasses any and all embodiments within the scope of the following claims.

I claim:

1. A kit for configuring a toilet for disabled persons, comprising:

a toilet seat having a front portion defining a first width and a back portion defining a second width, the first width being greater than the second width, the seat further defining a top surface and a bottom surface having a downward sloping wall configured for mating to a toilet bowl of a toilet;

wherein the top surface of the toilet seat has a channel configured to receive a conventional toilet seat; and a mounting plate attached to the back portion of the toilet seat, the mounting plate having at least one opening adapted for receiving a fastener for attaching the toilet seat to the toilet.

2. The kit for configuring a toilet according to claim 1, further comprising a lid.

3. The kit for configuring a toilet according to claim 1, wherein the kit further comprises a support member.

4. The kit for configuring a toilet according to claim 3, wherein the support member comprises a floor-mounted handle bar.

5. The kit for configuring a toilet according to claim 3, wherein the support member comprises at least one wall-mounted handle bar.

6. A kit for configuring a toilet for disabled persons, comprising:

a toilet seat having a front portion defining a first width and a back portion defining a second width, the first width being greater than the second width, the seat further defining a top surface and a bottom surface having a downward sloping wall adapted for mating onto a toilet bowl of a toilet;

wherein the top surface of the toilet seat has a channel configured to receive a conventional toilet seat;

a mounting plate to the back portion of the toilet seat, the mounting plate having at least one opening defined therein adapted for receiving a fastener for fastening the toilet seat onto the toilet; and a support member.

7. The kit for configuring a toilet according to claim 6, further comprising a lid.

8. The kit for configuring a toilet according to claim 6, wherein the support member comprises a floor-mounted handle bar.

9. The kit for configuring a toilet according to claim 6, wherein the support member comprises at least one wall-mounted handle bar.

10. A kit for configuring a toilet for disabled persons, comprising:

a toilet seat having a front portion defining a first width and a back portion defining a second width, the first width being greater than the second width, the seat further defining a top surface having a channel adapted for receiving a conventional toilet seat and a bottom surface having a downward sloping wall configured for mating onto a toilet bowl of the toilet;

a mounting plate attached to the back portion of the toilet seat, the mounting plate having at least one opening defined therein adapted for receiving a fastener for fastening the toilet seat onto the toilet;

a support member; and a lid.

11. The kit for configuring a toilet according to claim 10, wherein the support member comprises a floor-mounted handle bar.

12. The kit for configuring a toilet according to claim 10, wherein the support member comprises at least one wall-mounted handle bar.

* * * * *